United States Patent [19]

Fujitsuka

[11] Patent Number: 4,487,242

[45] Date of Patent: Dec. 11, 1984

[54] VERTICALLY SLIDABLE WINDOW

[75] Inventor: Akira Fujitsuka, Amagasaki, Japan

[73] Assignee: Alna Koki Co., Ltd., Amagasaki, Japan

[21] Appl. No.: 239,188

[22] Filed: Mar. 23, 1981

[30] Foreign Application Priority Data

Mar. 12, 1980 [JP] Japan ..... 55-33008
Mar. 12, 1980 [JP] Japan ..... 55-33009

[51] Int. Cl.[3] ..... E06B 3/44; E05F 17/00
[52] U.S. Cl. ..... 160/102; 49/116
[58] Field of Search ..... 49/116, 118, 119; 160/102, 105, 27, 28, 99, 100; 52/239

[56] References Cited

U.S. PATENT DOCUMENTS

| | | | |
|---|---|---|---|
| 1,021,492 | 3/1912 | Strauss | 49/119 |
| 1,023,723 | 4/1912 | Cossey | 49/116 |
| 1,418,550 | 6/1922 | Fentress | 49/119 |
| 1,807,425 | 5/1931 | McCalmon | 160/102 X |
| 2,120,986 | 6/1938 | Morris | 160/102 X |
| 2,568,800 | 9/1951 | Galla | 160/105 |
| 2,587,547 | 2/1952 | Steingruber | 49/119 X |
| 2,970,677 | 2/1961 | Springs, Jr. et al. | 52/239 X |
| 3,199,858 | 8/1965 | Koblensky | 49/118 |

*Primary Examiner*—Philip C. Kannan
*Attorney, Agent, or Firm*—Gabriel P. Katona

[57] ABSTRACT

A vertically slidable window comprises two upper and lower sashes to open and close the window opening. The vertical side members of the upper sash and the vertical side members of the lower sash are provided with toothed rack members opposed to each other and pinions are installed between each pair of rack members to mesh with the latter, so that the upper and lower sashes can be raised and lowered in interlocked relation.

1 Claim, 14 Drawing Figures

VERTICALLY SLIDABLE WINDOW

BACKGROUND OF THE INVENTION

The present invention relates to a vertically slidable window comprising two upper and lower sashes to open and close the window opening and is intended to provide a vertically slidable window whose opening and closing operation is easy and smooth and which enables the effective ventilation of the room.

Conventional windows of this vertically slidable type have been constructed such that the upper and lower sashes are tied to each other by a rope which is entrained around a pulley supported on a shaft on the upper end of the outer window frame so that the two sashes can be raised and lowered in interlocked relation. With this construction, however, if the rope breaks during use, the two sashes being raised or lowered suddenly fall and nip the user's hands, thus forming a cause of injury to him. Further, the rope tends to come off the pulley when twisted or vibrated, making it impossible to raise or lower the sashes, and prolonged use of the rope causes the elongation of the rope, making it impossible to raise or lower the sashes to the extreme limits, thus causing troubles to the opening and closing of the window.

Accordingly, an object of the invention is to provide a vertically slidable window which involves no danger of the sashes accidentally falling during the raising or lowering thereof, thus preventing injury to the user.

Another object of the invention is to provide a vertically slidable window which, even if given shocks or vibrations, will not cause troubles to the raising and lowering of the sashes, so that it can be used in a stabilized manner.

A further object of the invention is to provide a vertically slidable window wherein the upper and lower sashes, even if used for a long time, can be raised and lowered to the extreme limits, ensuring positive opening and closing of the window.

SUMMARY OF THE INVENTION

According to the invention, the upper and lower sashes are vertically slidably fitted in an outer window frame fixed to a window opening in a building or the like and the vertical side members of the upper sash and the vertial side members of the lower sash are equipped with toothed rack members opposed to each other, with pinions installed between each pair of opposed racks and meshing with the latter, said pinions being rotatably supported on shafts at the outer window frame. Thus, when the upper or lower sash is raised or lowered, the interlocking mechanism comprising said rack members and pinions causes the other lower or upper sash to be lowered or raised in interlocked relation to the mating sash, and if the weights of the sashes are balanced by each other, the sashes can be stopped at any position in the path of vertical travel without the danger of accidental fall.

Since the invention does not employ the rope suspension system, there is, of course, no possibility of such rope being broken to let the sashes fall accidentally. Further, even if vibrations, etc., are applied to the window frame, the raising and lowering operation is hardly influenced. The sashes can be raised and lowered to the extreme limits in interlocked relation even after they have been so operated for a long time. Thus, there is no possibility of malfunction that while one sash has been completely closed, the other remains half-opened, as in the conventional window of this type.

Further, the arrangement comprising pinions rotatably supported on shafts on the window frame at fixed positions and meshing with toothed rack members fixed to the sashes to enable the latter to be raised and lowered in interlocking relation, ensures smooth opening and closing of the window and produces almost no noise during raising and lowering of the sashes. While the conventional rope suspension system is liable to produce some time-lag between the timings of upward and downward movements of the sashes, the invention provides exact coincidence between such timings.

DETAILED DESCRIPTION OF THE PREFERRED EMBODIMENTS

Figure 1:
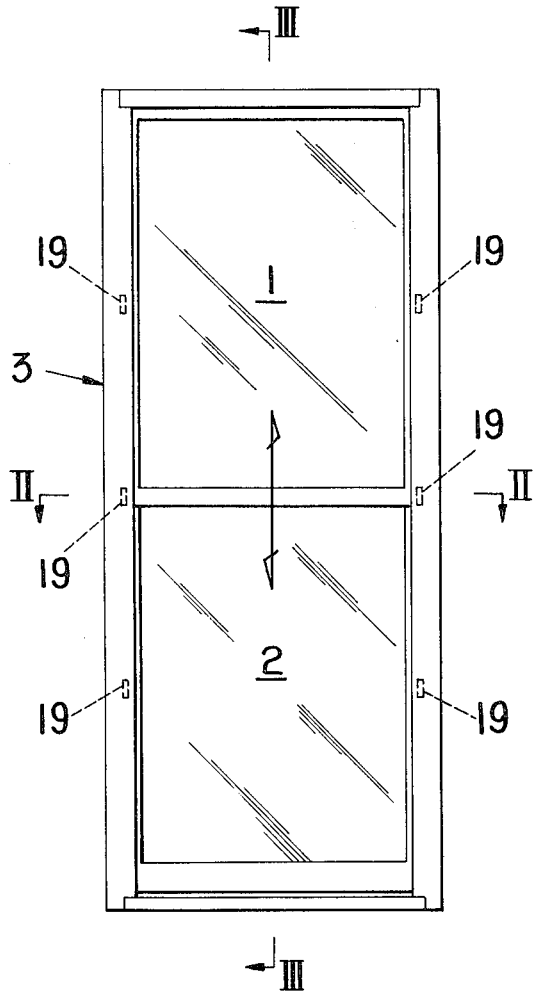
FIG. 1 is a schematic front view of a vertically slidable window, showing an embodiment of the invention.

FIG. 1 is a schematic view of a vertically slidable window, looking at the latter from inside the room. An outer window frame 3 attached to a building or the like has two upper and lower sashes 1 and 2 of the same size attached thereto so that they can be raised and lowered in interlocked relation. It is so arranged that as the sashes move relative to each other from the illustrated completely closed position with the upper sash 1 downward and the lower sash 2 upward, the upper and lower regions of the window are gradually opened, the completely opened position being attained when the two sashes 1 and 2 come to coincide with each other.

Figure 2:
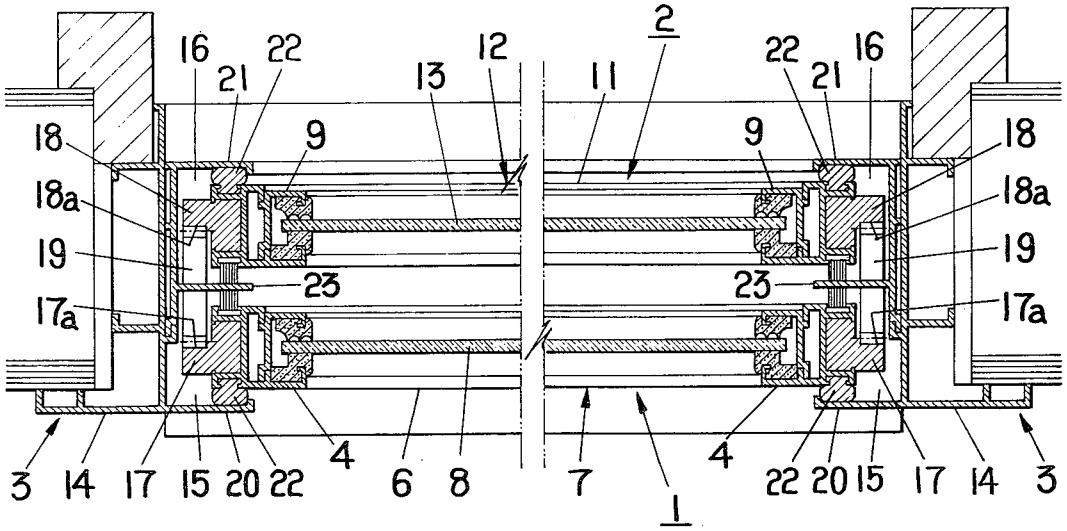
FIG. 2 is an enlarged section taken along the line II—II of FIG. 1.
Figure 3:
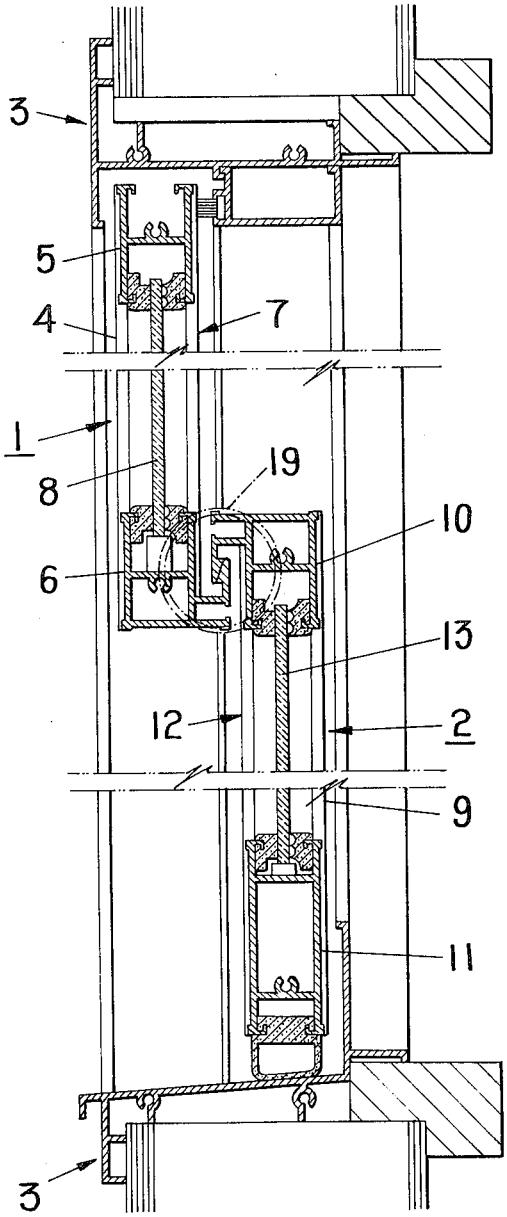
FIG. 3 is an enlarged section taken along the line III—III of FIG. 1.

The detailed arrangement of this vertically slidable window will now be described with reference to FIGS. 2 and 3.

Figure 4:
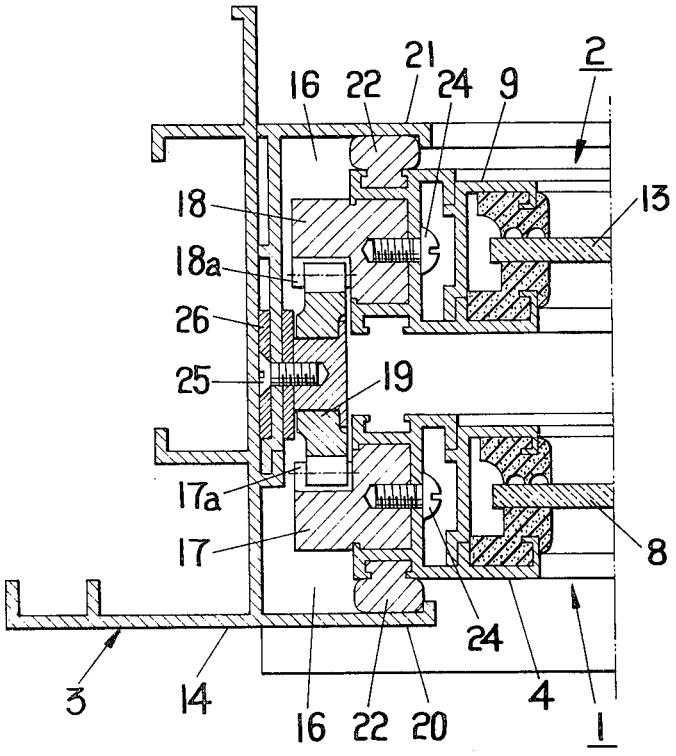
FIG. 4 is an enlarged section of a pinion and toothed rack member.

The upper sash 1 comprises an inner window frame 7 composed of right and left vertical side members 4 and upper and lower horizontal side members 5 and 6, with a glass pane 8 fitted in said inner window frame 7. The lower sash 2 comprises an inner window frame 12 composed of right and left vertical side members and an upper and lower horizontal side members 10 and 11, with a glass pane 13 fitted in said inner window frame 12. The upper sash 1 is fitted in outer rail grooves 15 in the right and left side frames 14 of the outer window frame 3, while the lower sash 2 is fitted in inner rail grooves 16 in said side frames 14. The vertical side members 4 and 9 of the inner window frames 7 and 12 have members 17 and 18 fixed thereto at opposed positions by screws 24 (see FIG. 4), said members 17 and 18 being provided with toothed racks 17*a* and 18*a*, respectively, and the side frames 14 of the outer window frame 3 are provided with pinions 19 meshing with the racks 17*a* of the members 17 and with the racks 18*a* of the members 18, said pinions 19 being supported on shafts intermediate between the outer rail grooves 15 and the inner rail grooves 16 and each being held in position by a screw 25 and a washer 26 (see FIG. 4). The vertical side members 4 and 9 of the inner window frames 7 and 12 are each provided with guide bushings 22 at a plurality of positions for slide contact with the inner surfaces of the outer side walls 20 of the outer rail grooves 15 and the inner surfaces of the outer side walls 21 of the inner rail grooves 16, so as to ensure smooth upward and downward movements of the sashes without rattling. In addition, the pinions 19 are disposed intermediate between the rail grooves 15 and 16, but since partition walls 23 which separate the rail grooves 15 and 16 from each other extend to the positions of said pinions, the corresponding portions of said partition walls 23 are cut away, though not clearly illustrated. Further, as shown in FIGS. 1 and 5, the pinions 19 are arranged at required intervals along said rail grooves 15 and 16, the number of said pinions being preferably at least three, whereby the sashes can be raised and lowered more smoothly and lightly.

Figure 5A:
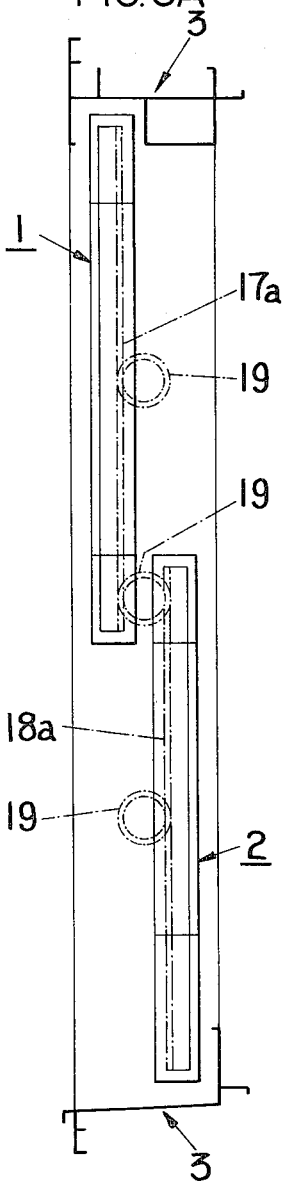
FIG. 5 (A) and (B) are schematic explanatory view, illustrating the upward and downward movements of the upper and lower sashes.
Figure 5B:
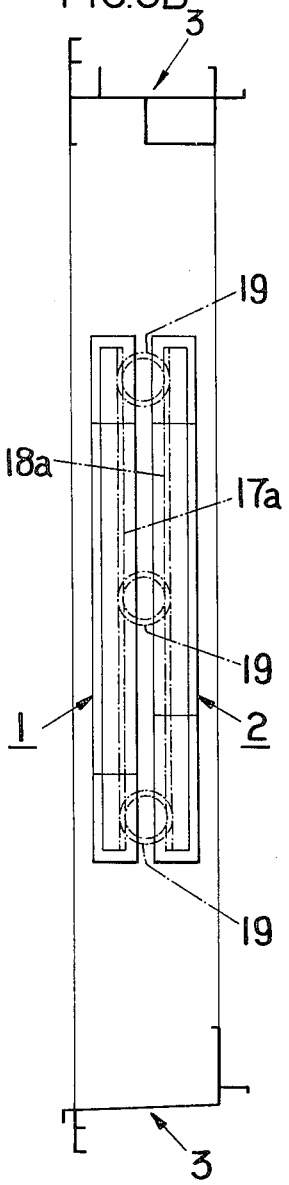

FIG. 5 (A) shows the completely closed window position. If the upper sash 1 is pulled downwardly from this completely closed position, the racks 17*a* rotate the pinions 19 counterclockwise, the rotation of the pinions 19 being transmitted to the racks 18*a* to move the lower sash 2 upwardly. Thus, the upper and lower regions of the window are symmetrically and gradually opened. When the upper and lower sashes 1 and 2 come to coincide with each other, as shown in FIG. 5 (B), the window is opened to the fullest extent, establishing the completely opened window position. In addition, the above description refers to a case where by downwardly pulling the upper sash 1, the lower sash 2 is simultaneously raised, but the same result can be attained by upwardly pulling the lower sash 2 so as to lower the upper sash 1. In this embodiment, in which the upper sash 1 is located on the outer side, the former method is convenient for operation from outside the room while the latter method is convenient for operation from inside the room.

Figure 6:
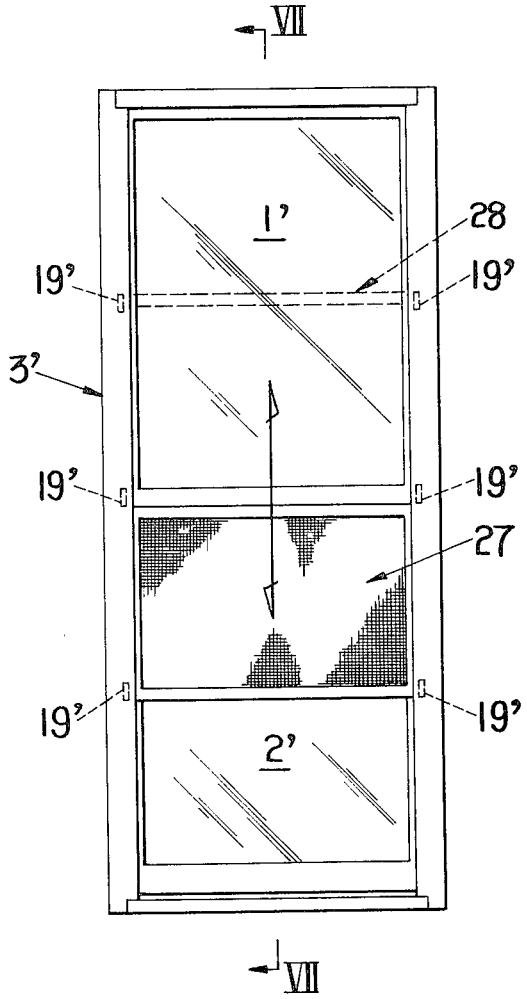
FIG. 6 is a schematic front view of another embodiment of the invention.

FIG. 6 and the following figures show another embodiment of the invention. FIG. 6 is a schematic view of a vertically slidable window, looking at the latter from outside the room. Upper and lower sashes 1' and 2' fitted in an outer window frame 3' have window screens 27 and 28 connected to the lower and upper portions thereof, respectively. It is so arranged that as the sashes move relatively to each other from the illustrated completely closed position with the upper sash 1' downward and the lower sash 2' upward, the upper and lower regions of the window are gradually opened, the completely opened position being attained when the two sashes come to coincide with each other. In this completely open position, the opened regions of the window are closed by the window screens 27 and 28.

Figure 7:
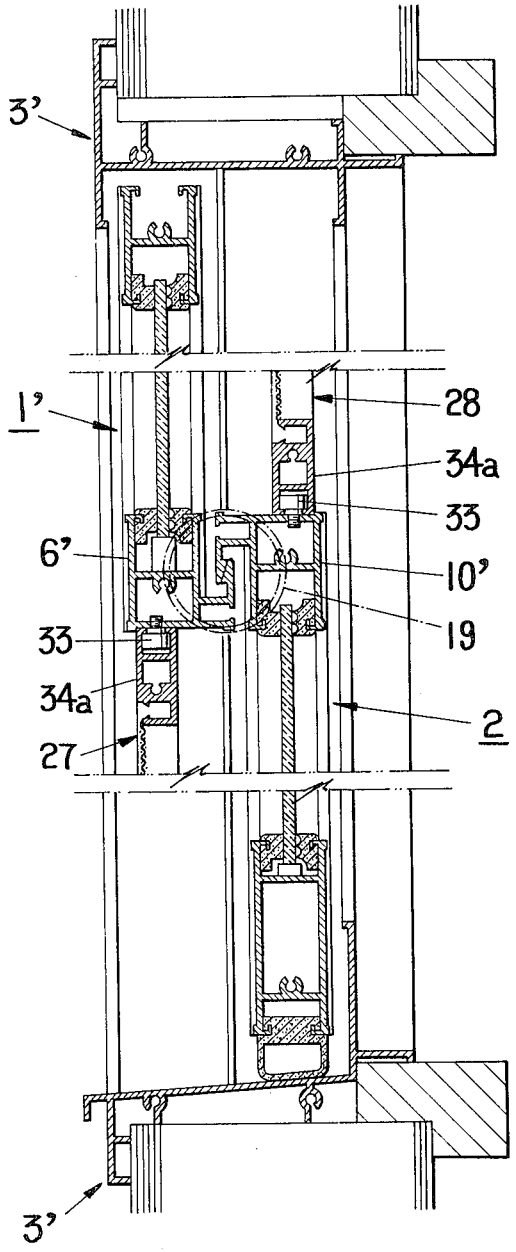
FIG. 7 is an enlarged section taken along the line VII—VII of FIG. 6.
Figure 8A:
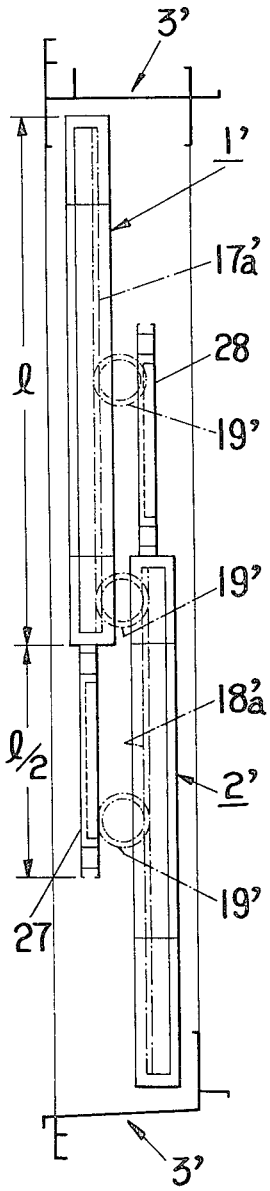
FIG. 8 (A), (B) and (C) are schematic explanatory views, illustrating the upward and downward movements of the upper and lower sashes.
Figure 8B:
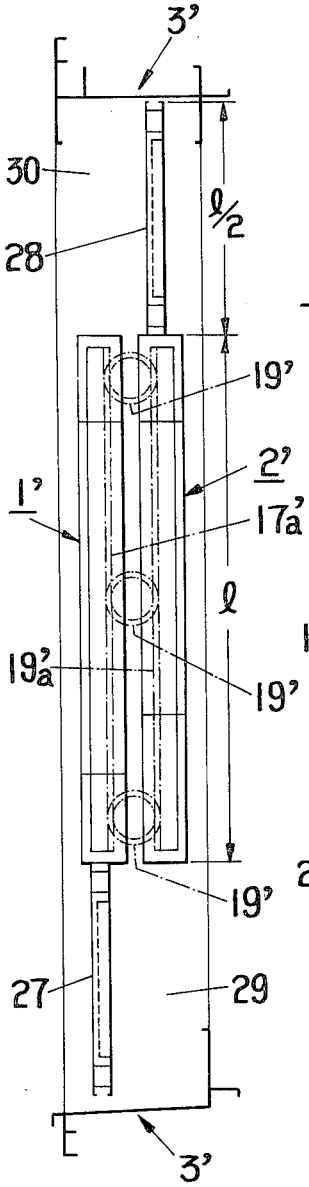
Figure 8C:
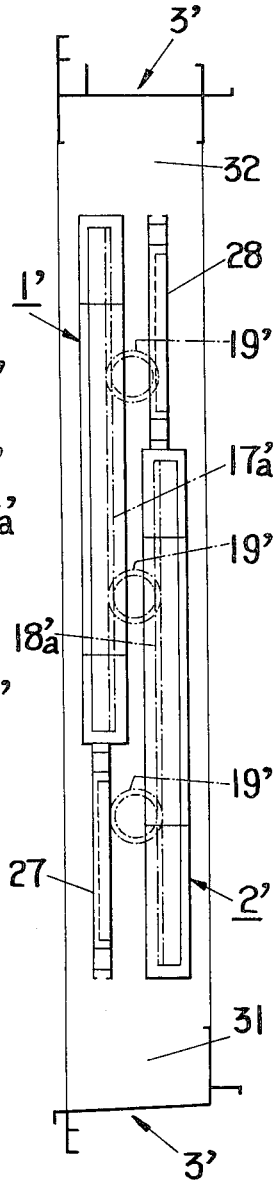

As shown in FIGS. 7 and 8, the window screens 27 and 28 have half the height of the upper and lower sashes 1' and 2', respectively, and are fixed to the lower horizontal frame 6' of the upper sash 1' and the upper horizontal frame 10' of the lower sash 2', respectively. FIG. 8 (A) shows the completely closed window position. If the upper sash 1' is pulled downwardly from this completely closed position, the racks 17'*a* rotate the pinions 19' counterclockwise, the rotation of the pinions 19' being transmitted to the other racks 18'*a* to move the lower sash 2' upwardly. Thus, the upper and lower regions of the window are symmetrically and gradually opened. When the upper and lower sashes 1' and 2' come to coincide with each other, as shown in FIG. 8 (B), the window is opened to the fullest extent, establishing the completely opened window position. In this completely opened position, the lower opened region 29 and the upper opened region 30 of the window are closed by the window screens 27 and 28, respectively. FIG. 8 (C) shows a position intermediate between the completely closed position of FIG. 8 (A) and the completely opened position of FIG. 8 (B), wherein the lower end of the window screen 27 associated with the upper sash 1' coincides with the lower end of the lower sash 2' while the upper end of the window screen 28 associated with the lower sash 2' coincides with the upper end of the upper sash 1', so that the two sashes 1', 2' and window screens 27, 28 coincide with each other. In this state, the largest passages 31 and 32 are defined in the upper and lower regions of the window.

Figure 9:
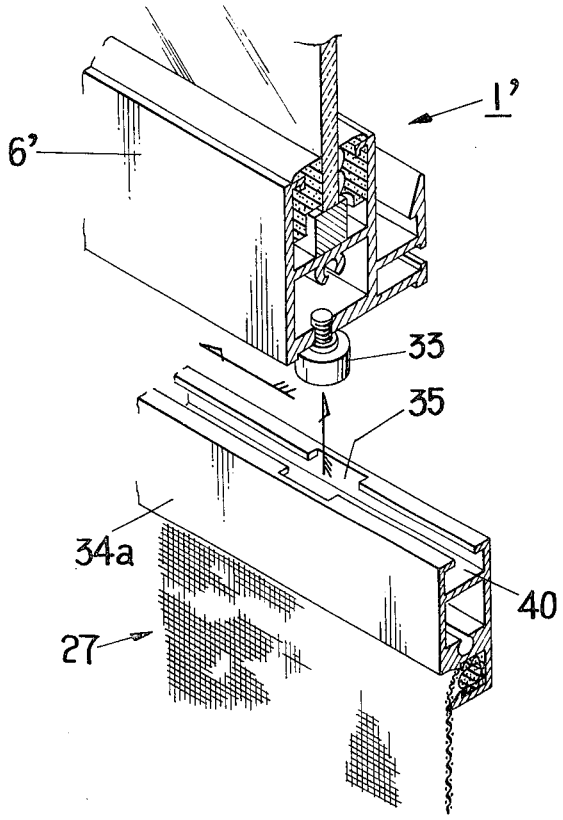
FIG. 9 is an explanatory view, showing how to attach a window screen to the sash.
Figure 10A:
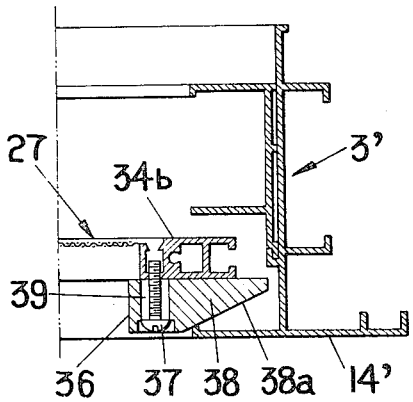
FIG. 10 (A) and (B) are views of a keep element for preventing rattling of the window screen, illustrating how to attach said keep element to the window screen.
Figure 10B:
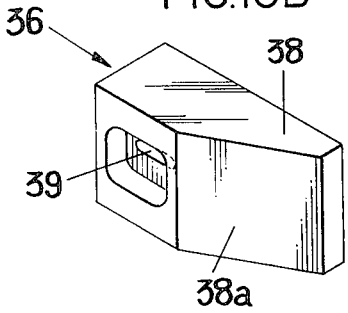

Attachment of the window screens 27 and 28 to the upper and lower sashes 1' and 2' is effected as follows: in the case of the upper sash 1', at least two locking elements 33 as shown in FIG. 9 are attached to the lower surface of the lower horizontal frame 6' of the upper sash 1'. On the other hand, the upper surface of the upper side member of the frame of the window screen 27 is formed with a locking element receiving opening 35 for each locking element, as shown in the same figure, located at a position somewhat deviated from the position that corresponds to the associated locking element. Then, under the upper sash 1', the window screen 27 is vertically raised to insert the locking elements 33 into the openings 35, whereupon said window screen 27 is horizontally moved a little distance along a locking groove 40 so as to lock the locking elements 33 in the upper side member 34*a*. In addition, if the window screen is not needed, it can be easily removed from the sash by moving it in the opposite direction. The window screen 28 can be attached by the same method. With the locking elements 33 alone employed, however, the window screens 28, 29 would tend to rattle. Therefore, a window screen keep element 36 of substantially trapezoidal shape as shown in FIG. 10 (A) and (B) is attached to the outer surface of each side frame 34*b* of the window screens 27, 28 by a screw 37, with the wedge-like portion 38 of said keep element 36 being engaged in the side frame 14' of the outer window frame 3' by utilizing its taper surface 38*a* and a screw receiving elongated opening 39. In addition, the window screens have been described as removably attached to the sashes in this embodiment, but they may be integrally attached to the sashes.

In this embodiment, as described above, window screens having approximately half the height of the sashes are connected to the lower portion of the upper sash and to the upper portion of the lower sash. Therefore, in the completely opened window position where the upper and lower sashes coincide with each other, the upper and lower opened regions of the window are closed by the window screens, the latter satisfactorily performing their function as preventing insects from entering the room and also carrying out a ventillation function. Further, the intermediate position between the completely opened position and the completely closed position provides passages which are not shut even by the window screens. This provides an advantage that when it is desired to take flower boxes or the like placed on the veranda into the room or to take such articles out of the room into the outside, they can be taken in and out as desired by making use of said passages.

What is claimed is:

1. A vertically slidable window for covering a window opening when the window is closed, said window having upper and lower sashes which open and close the window opening, said upper and lower sashes each being provided with vertical side members having rack members positioned therein in opposed relationship to a rack member on the other sash; at least three pinions interposed between said opposed rack members, said pinions meshing into said opposed rack members, an outer window frame on which said slidable window is mounted, said pinions being arranged at suitable intervals in the direction of the side walls of the outer window frame and supported in the outer window frame, the lower portion of said upper sash and the upper portion of said lower sash each having attached thereto a window screen member, each of said window screen members being adapted to move integrally with the sash to which it is attached when said sash is moved upwardly or downwardly, the height of each of said window screen members being about a half the height of the sash to which it is attached, said window screen members being removably attached to their associated sashes by means of a locking arrangement comprising a locking groove cut in the horizontal member of said screen member adjacent to its associated sash member, said locking groove being enlarged at at least one point to receive a locking element, said locking element being attached to and extending away from the margin of said sash member adjacent to its associated screen member, said locking element being adapted to be inserted into the enlargement of said groove, whereby said screen member may be attached to its associated sash member by inserting said locking element in said groove enlargement and moving said screen member and associated sash member laterally with respect to each other, said slidable window being provided with guide bushings which are in contact with the said frames of the outer window frame for vertically guiding the upper and lower sashes, said bushings being attached to the vertical frames of the upper and lower sashes, said window screen members being provided with keep elements of substantially trapezoidal shape having a tapered surface which are in contact with the side frames of the outer window frame for vertically guiding the window screens, said keep elements being attached to the side frames of each of said window screens.

* * * * *